US007380504B2

(12) United States Patent
Dryer

(10) Patent No.: US 7,380,504 B2
(45) Date of Patent: Jun. 3, 2008

(54) TELESCOPED PROJECTILE

(75) Inventor: Richard Dryer, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 298 days.

(21) Appl. No.: 11/204,575

(22) Filed: Aug. 16, 2005

(65) Prior Publication Data

US 2008/0000380 A1 Jan. 3, 2008

(51) Int. Cl.
*F42B 14/00* (2006.01)

(52) U.S. Cl. ..... 102/520; 102/503; 244/3.26

(58) Field of Classification Search ..... 102/520, 102/503; 244/3.26
See application file for complete search history.

(56) References Cited

U.S. PATENT DOCUMENTS

| | | | | |
|---|---|---|---|---|
| 3,158,100 | A * | 11/1964 | Finley | 102/377 |
| 3,677,179 | A * | 7/1972 | Potteiger et al. | 102/473 |
| 3,698,320 | A | 10/1972 | Cochran et al. | |
| 3,842,741 | A * | 10/1974 | Brothers et al. | 102/490 |
| 4,448,129 | A | 5/1984 | Gabriels | |
| 4,944,226 | A | 7/1990 | Wedertz et al. | |
| 5,005,781 | A | 4/1991 | Baysinger et al. | |
| 5,133,242 | A | 7/1992 | Witt | |
| 5,139,216 | A | 8/1992 | Larkin | |
| 5,483,863 | A * | 1/1996 | Dreizin | 89/8 |
| 6,364,248 | B1 | 4/2002 | Spate et al. | |
| 6,371,030 | B1 * | 4/2002 | Gilman et al. | 105/529 |
| 6,565,036 | B1 | 5/2003 | Palathingal et al. | |
| 6,817,568 | B2 | 11/2004 | Spate et al. | |
| 7,036,434 | B1 * | 5/2006 | Vo et al. | 102/522 |
| 2003/0057320 | A1 * | 3/2003 | Schneider et al. | 244/63 |
| 2004/0055502 | A1 * | 3/2004 | Hunn et al. | 102/519 |

FOREIGN PATENT DOCUMENTS

| | | |
|---|---|---|
| DE | 8809272 | 11/1989 |
| FR | 406184 | 1/1910 |
| FR | 2602042 | 1/1988 |

OTHER PUBLICATIONS

International Search Report from corresponding PCT application No. PCT/US2006/30771.

* cited by examiner

*Primary Examiner*—Michael J. Carone
*Assistant Examiner*—Gabriel J Klein
(74) *Attorney, Agent, or Firm*—Renner, Otto, Boisselle & Sklar, LLP

(57) ABSTRACT

A projectile reconfigures in flight from a launch configuration, in which the center of gravity is aft of the center of pressure, to a flight configuration, in which the center of gravity is forward of the center of pressure. The projectile includes a forward portion and an aft portion, and the reconfiguration involves movement of at least part of one of the portions relative to the other portion. The projectile may have an overall substantially conical shape when in the launch configuration. The forward portion may include a substantially conical nose, and a cylindrical central body attached to the nose. In the launch configuration, at least part of the central body may be located within a hollow in a base of the aft portion. The base may be slidable relative to the central body.

17 Claims, 5 Drawing Sheets

TELESCOPED PROJECTILE

TECHNICAL FIELD OF THE INVENTION

The invention relates to the field of launched projectiles.

DESCRIPTION OF THE RELATED ART

In the field of high-speed projectiles, large forces are often used to accelerate the projectile during launch. Thus, a rugged design is needed for the projectile. In addition, the projectile must have a low-drag profile, for example having a conical shape. Still, for stability in flight it is highly desirable for the center of gravity of the projectile to be forward of the center of pressure. It is difficult to obtain both of these characteristics in a projectile that is rugged enough to withstand the high acceleration forces of launch.

In addition, there are difficulties in using control surfaces to guide flight of the projectile. Aerodynamic control systems may have reduced effectiveness or may be substantially ineffective in exoatmospheric environments. In addition, for hypersonic projectiles, ablation of control surfaces may be a problem.

From the foregoing it may be appreciated that improvements may be had with regard to such projectiles.

SUMMARY OF THE INVENTION

According to an aspect of the invention, a projectile has a launch configuration with a center of gravity aft of its center of pressure, and a flight configuration with its center of gravity forward of its center of pressure. The projectile may transition from the launch configuration to the flight configuration by relative movement of parts of the projectile.

According to another aspect of the invention, a projectile includes an extendable base. The base is deployed at the beginning of flight, increasing the length of the projectile relative to its compact launch configuration. Extending the base of the projectile shifts the configuration of the projectile such that the center of gravity of the projectile moves from being aft of the center of pressure of the projectile to being forward of the center of pressure.

According to still another aspect of the invention, a hypersonic projectile is in a relatively compact and rugged launch configuration during launch, and transitions to a flight configuration which is inherently stable for flight.

According to still another aspect of the invention, a projectile is launched from an electromagnetic rail gun in a relatively rugged launch configuration, with its center of gravity aft of its center of pressure. After launch, the projectile transitions to an inherently-stable flight configuration, with its center of gravity forward of its center of pressure.

According to a further aspect of the invention, a projectile internally re-configures its mass to transition from a launch configuration for launch, to a flight configuration for flight.

According to a still further aspect of the invention, a projectile has one or more telescoped sections that may be extended after launch. The extending of the section alters the relative positioning of the projectile's center of gravity (center of mass) and the projectile's center of pressure.

According to another aspect of the invention, a projectile includes a forward portion; and an aft portion mechanically coupled to the forward portion. At least part of one of the portions is movable relative to the other of the portions such that: 1) a center of gravity of the projectile is forward of a center of pressure of the projectile when the at least part of the one of the portions is in a first relative position to the other of the portions; and 2) the center of gravity of the projectile is aft of the center of pressure of the projectile when the at least part of the one of the portions is in a second relative position to the other of the portions.

According to still another aspect of the invention, a method of delivering a projectile to a target includes: launching the projectile in a launch configuration with a center of gravity of the projectile aft of a center of pressure of the projectile; shifting the projectile to a flight configuration with the center of gravity forward of the center of pressure; and flying the projectile to the target.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

A projectile reconfigures in flight from a launch configuration, in which the center of gravity is aft of the center of pressure, to a flight configuration, in which the center of gravity is forward of the center of pressure. The projectile includes a forward portion and an aft portion, and the reconfiguration involves movement of at least part of one of the portions relative to the other portion. The projectile may have an overall substantially conical shape when in the launch configuration. The forward portion may include a substantially conical nose, and a cylindrical central body attached to the nose. In the launch configuration, at least part of the central body may be located within a hollow in a base of the aft portion. The base may be slidable relative to the central body, such that the base is deployed aftward relative to the central body in order for the projectile to attain its flight configuration. Put another way, the portions of the projectile may be telescoped when the projectile is in a launch configuration, and may extend to reconfigure the projectile into a flight configuration. A mechanical stop on the central body or the base may be used to limit deployment of the base, and/or to lock the base into place relative to the central body. Lateral thrusters or other methods may be used to steer the projectile in flight. The configurable projectile, with the base telescopically deploying relative to the central body, may be a hypersonic projectile, such as a projectile launched using an electromagnetic rail gun. The projectile advantageously provides good strength characteristics for a very large acceleration during launch, while providing the desirable stable relationship between center of pressure and center of gravity during flight. Deployment of the projectile into the flight configuration may be automatic upon launch, without the need for any internal power source or mechanism to actively deploy the projectile into its flight configuration. Since the projectile does not require any control surfaces for steering, it is suitable for use in environments where control surfaces would be ineffective (such as in space), or environments where control surfaces might encounter high heat loads leading to ablation.

Figure 1:
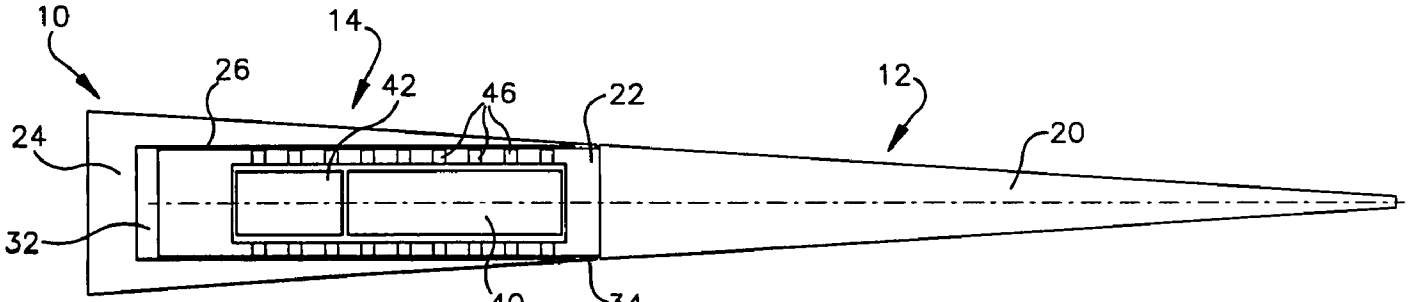
FIG. 1 is a side sectional view of a projectile according to the present invention, with the projectile in a launch configuration.
Figure 2:
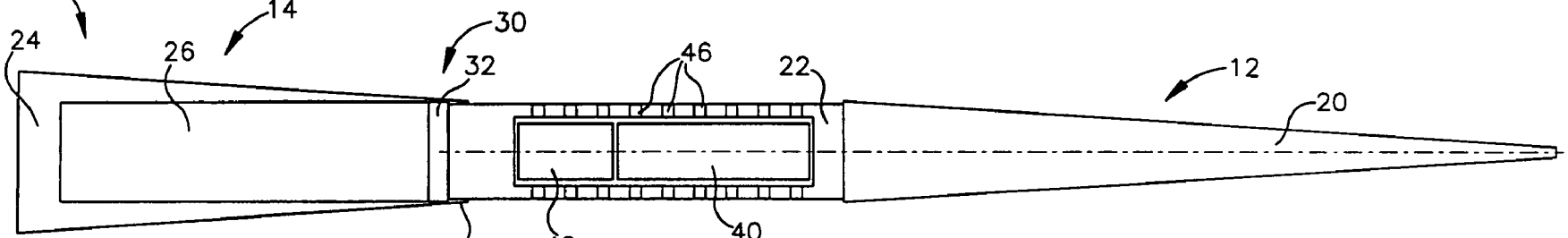
FIG. 2 is a side sectional view of the projectile of FIG. 1, with the projectile in a flight configuration.

FIGS. 1 and 2 show a projectile 10 that includes a forward portion 12 and an aft portion 14. The forward portion 12 includes a nose 20 and a central body 22. The aft portion 14 includes a base 24. The base 24 is slidable along the central body 22 to allow reconfiguration of the projectile 10 from a launch configuration, shown in FIG. 1, to a flight configuration, shown in FIG. 2. In the launch configuration the base 24 encloses the central body 22, with the central body 22 located within a central cylindrical cavity 26 in the base 24. The base 24 may extend or deploy to the flight configuration of FIG. 2 by sliding of the base 24 backward along the central body 22. A mechanical stop 30 may be located on the central body 22 and/or on the base 24, in order to limit extension of the base 24. The stop 30 may also serve to mechanically secure or lock the base 24 in its extended or deployed position. The stop 30 may be any of a variety of mechanical or other mechanisms for maintaining a pair of parts temporarily or permanently in a desired positional arrangement. As one example, the mechanical stop 30 may include a ridge or wedge portion 32 at an aft end of the central body 22, which engages an inner lip, ridge, or wedge portion 34 at a forward end of the base 24. The portions 32 and 34 may frictionally or otherwise engage together to maintain the base 24 in an extended position. It will be appreciated that a wide variety of other suitable mechanisms, for example, detents, mechanical locking surfaces, or magnets, may alternatively be utilized.

The nose 20 may have a conical shape. The base 24 may have a truncated conical outer surface that engages with the nose 20 to form a single conical shape when the projectile 10 is in its launch configuration (FIG. 1). The nose 20 may be a single solid piece of a suitable heavy material that causes damage when impacting a target. Examples of such materials include tungsten and depleted uranium. Alternatively, the nose 20 may be a hollow cone filled with suitable munition materials, for example, being filled with preformed fragments and being configured to burst in proximity to a target to disseminate smaller fragments or shrapnel. References herein to a projectile being flown to a target or to impact a target should be understood as including projectiles configured to detonate or otherwise fragment prior to actual impact with the target.

The projectile 10 has a navigation unit 40 located in the central body 22. The navigation unit 40 may be powered by a suitable battery 42. The navigation unit 40 aids in keeping the projectile 10 on a desired course towards its intended destination or target. The navigation unit 40 may be programmed with desired coordinates or location of a target. It may utilize a dead reckoning inertia system or a global positioning system (GPS) guidance system.

The navigation unit 40 may be operatively coupled to a series of lateral thrusters 46 located about the periphery of the central body 22. The lateral thrusters 46 are single-use thrusters which may be used to provide bursts of thrust for correction of the course of the projectile 10. The lateral thrusters 46 may utilize any of a wide variety of suitable solid propellant-producing energetic materials. An example of suitable such materials are single- and double-based mixtures of nitrous cellulous and nitroglycerin. The lateral thrusters 46 may also have a suitable ignition device, such as a bridge wire device, to initiate reaction within the propellant. In addition, the lateral thrusters may each have a small nozzle for suitable expansion of the propellant material, in order to provide suitable thrust.

The projectile 10 may include hundreds of the lateral thrusters 46, for example, having about 200 thrusters 46 mounted at various locations around the central body 22. It will be appreciated that it is well known how to use the battery 42 to activate the ignition devices of the lateral thrusters 46, and how to use the navigation unit 40 to determine suitable times for actuating various of the lateral thrusters 46.

The central body 22 and the base 24 may be made of suitable materials, for example being made of a suitable type of steel.

The projectile 10 may be usable at very high velocities. For example, the projectile 10 may be a hypersonic projectile suitable for use at speeds far in excess of the speed of sound. Since the projectile 10 does not utilize any external control surfaces, such as fins or canards, it is suitable for use at very high speeds that might cause ablation in such control surfaces. Also the projectile 10 is suitable for use in exoatmospheric regions where atmospheric density is too low to permit effective use of control surfaces that rely on an atmosphere to be effective.

Figure 3:
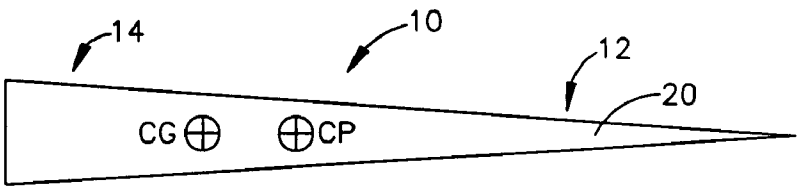
FIG. 3 is a schematic diagram of the projectile of FIG. 1 in a launch configuration, illustrating the locations of the center of gravity and the center of pressure.
Figure 4:
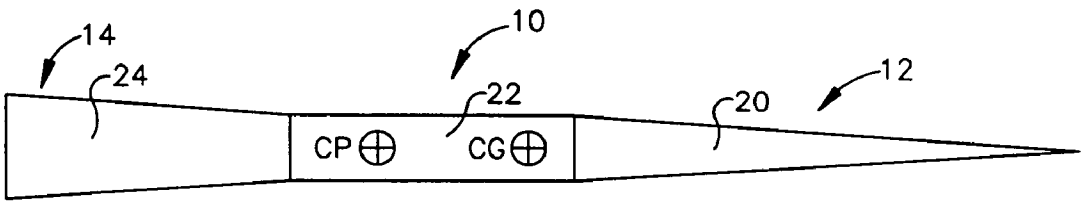
FIG. 4 is a schematic diagram of the projectile of FIG. 1 in a flight configuration, illustrating the locations of the center of gravity and the center of pressure.

FIGS. 3 and 4 schematically illustrate the relative locations of the center of gravity (CG) and center of pressure (CP) of the projectile 10 in the launch configuration (FIG. 3) and in the flight configuration (FIG. 4). The center of gravity is a point within the projectile 10 where inertia forces on the projectile 10 would act. The center of pressure is the point within the projectile 10 about which any aerodynamic forces on the projectile 10 would act. It will be appreciated that since the projectile 10 is axisymmetric in the illustrated embodiments, both the CG and CP are located along a centerline of the projectile 10.

When the projectile 10 is in the launch configuration, shown in FIG. 3, the center of gravity CG is aft of the center of pressure CP. This location of the CG behind or aft of the CP would be an unstable configuration for the projectile 10 during flight. Therefore, for flight the projectile 10 reconfigures into the flight configuration as shown in FIG. 4, with the CG forward or in front of the CP. This configuration, with the CG forward of the CP, produces inherently stable flight.

There is no inherent requirement that the CG be aft of the CP during launch. Configuring the projectile in a robust manner, to support itself during the high acceleration launch environment, results in a structural configuration wherein the CG is aft of the CP. These structural considerations become increasingly important for the large accelerations that may be necessary for launching hypersonic projectiles. To make such projectiles inherently stable in a conical launch configuration, it is often necessary to place high density material in the nose of the projectile, with a hollow conical skirt of high-strength steel attached to the heavy conical nose. As additional devices are required to be included in hypersonic projectiles, and as speeds and accelerations are increased, it becomes more and more difficult with such a design to maintain a small projectile size and to maintain integrity of the high-strength steel conical skirt. This invention provides a solution wherein the projectile may be optimized for launch survivability, in a configuration which is inherently unstable (CG aft of CP), and independently optimized for flight stability (CG forward of CP). In other words, the projectile 10 advantageously provides a rugged launch configuration and a stable flight configuration.

The projectile 10 also advantageously covers the thrusters 46 when the projectile 10 is in the launch configuration. This may aid in preventing damage or degradation of performance of the thrusters 46, which might otherwise occur during storage or launch.

The projectile 10 may be capable of sustaining very high accelerations reached in certain launch or firing mechanisms. For example, the projectile 10 may be capable of withstanding in excess of 10,000 g's, may be capable of withstanding in excess of 30,000 g's, and/or may be capable of withstanding forces in a range of 30,000 to 50,000 g's.

The projectile 10 may have any of a range of suitable sizes. In one example embodiment, the projectile 10 may have a length between about 60 to 90 cm (24 to 36 inches), with a diameter at its aft end of about 10 to 13 cm (4 to 5 inches).

The projectile 10 may be utilized as a surface-launched hypersonic projectile that may follow the trajectory through space and may be used to engage surface targets at ranges on the order of 400 km (250 miles).

The projectiles described herein are unpowered projectiles. Unpowered projectiles are defined herein as projectiles which receive substantially all of their forward momentum during launch, and which do not generate any substantial amount of forward thrust during flight. Missiles that generate forward thrust during all or a portion of flight do not qualify as unpowered projectiles, as the phrase is used herein. Nonetheless, it will be appreciated that at least some of the concepts described herein may be utilized in powered missiles.

Figure 5:
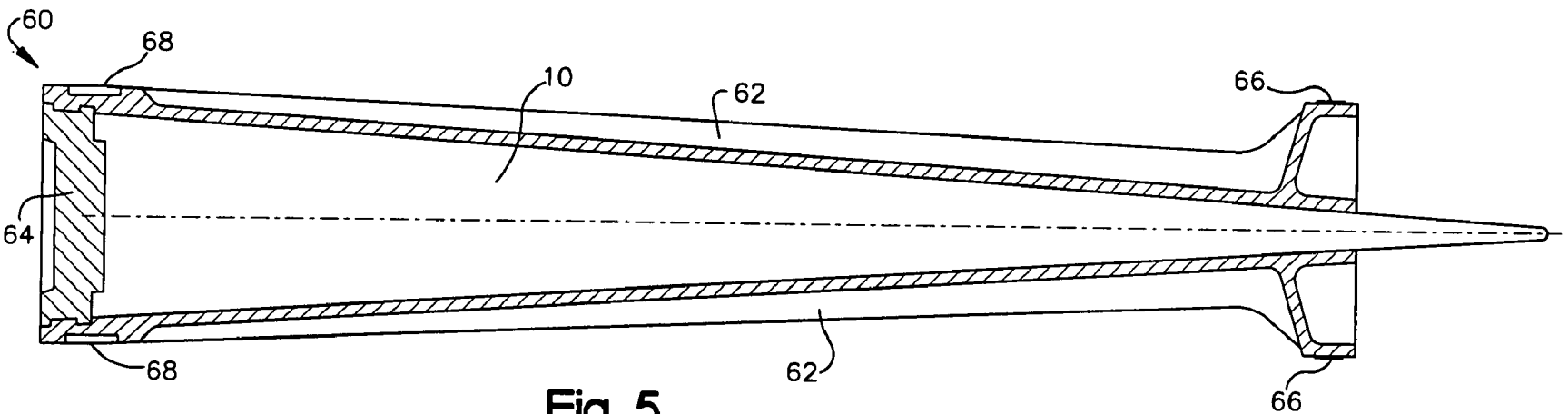
FIG. 5 is a side sectional view of an integrated launch package that includes the projectile of FIG. 1.

Turning now to FIG. 5, the projectile 10 is shown as part of an integrated launch package 60. The launch package 60 includes a sabot 62 and a pusher plate 64. The sabot 62 is a multi-part structure that circumferentially surrounds at least part of the projectile 10, in order to keep the projectile 10 aligned and centered within a launch tube or other launcher. The sabot 62 may, for instance, be in 4 sections that automatically come apart and fall away after the integrated launch unit 60 is expelled from a launcher. The integrated launch package 60 may be configured to fit in a substantially rectangular opening. To keep the sabot 62 aligned in the launcher the sabot 62 has a bore rider 66 in its forward part and an obturater 68 toward its aft end. The bore rider 66 and the obturater 68 make contact with walls or other suitable parts of the launcher, keeping the integrated launch package 60 aligned within the launcher. The obturater 68 may also act as a seal for launchers that utilize pressurized gases or other pressure.

The pusher plate 64 is, like the sabot 62, configured to fall away from the projectile 10 after launch. The pusher plate 64 is a plate of steel or another suitable strong material which is used to transmit forward force to the aft end of the projectile 10. The pusher plate 64 is also in contact with the sabot 62, and thereby also directly transmits force to the sabot 62.

Figure 6:
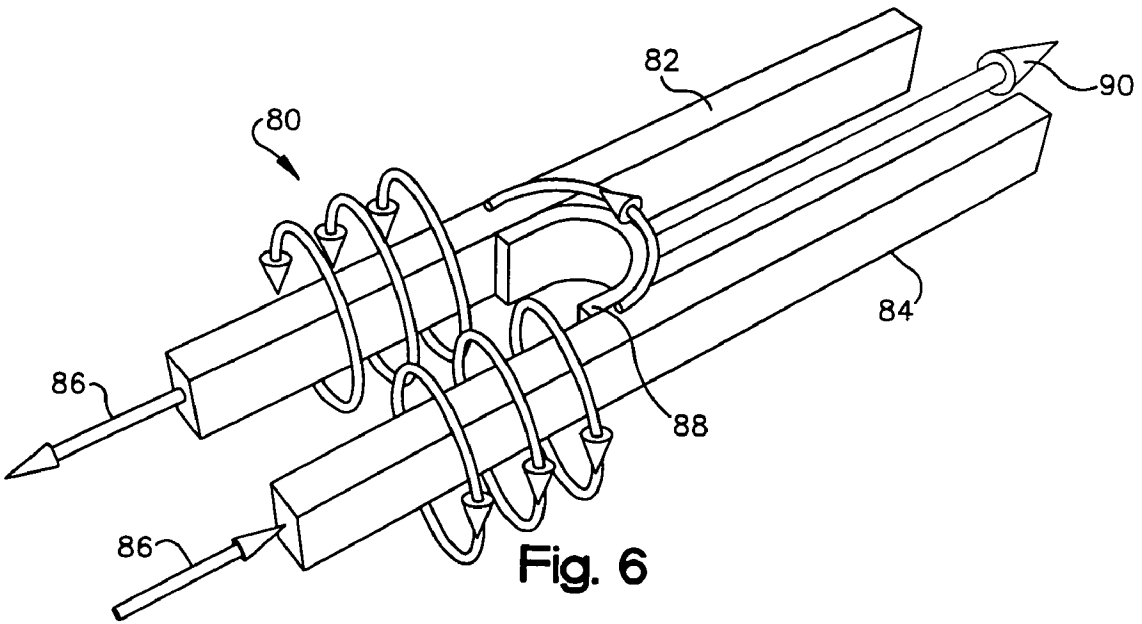
FIG. 6 is a schematic diagram illustrating operation of an electromagnetic rail gun that may be used for launching the projectile of FIG. 1.

FIG. 6 schematically illustrates an electromagnetic launcher 80 that may be used to provide rapid acceleration to the integrated launch package 60. The launcher 80 has a pair of parallel rails 82 and 84. A driving current 86 is passed into one of the rails 82, through an armature 88, and back out of the other rail 84. The current flowing in the rails 82 and 84 produces a magnetic field about the rails 82 and 84. This magnetic field interacts with the current and the armature 88 to produce a force 90 parallel to the rails 82 and 84. The force 90 may be used to produce very high accelerations in a projectile. The armature 88 may be part of the projectile 10, may be part of the integrated launch package 60, or may be configured to interact with the integrated launch package 60, in order to produce an acceleration in the projectile 10.

Figure 7:
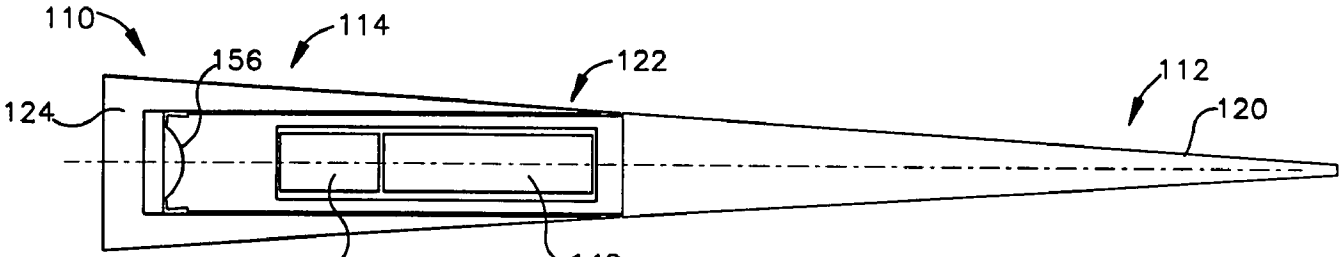
FIG. 7 is a side sectional view of an alternate embodiment projectile in accordance with the present invention, with the projectile shown in a launch configuration.
Figure 8:
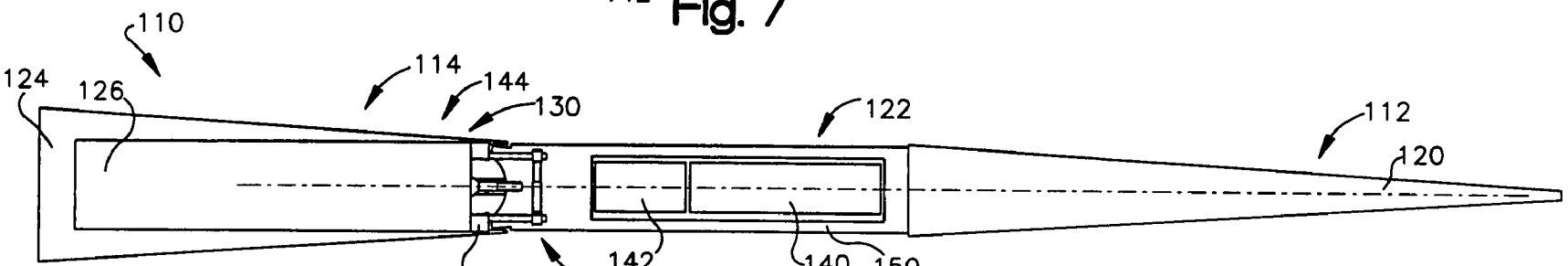
FIG. 8 is a side sectional view of the projectile of FIG. 7, with the projectile in a flight configuration.
Figure 9:
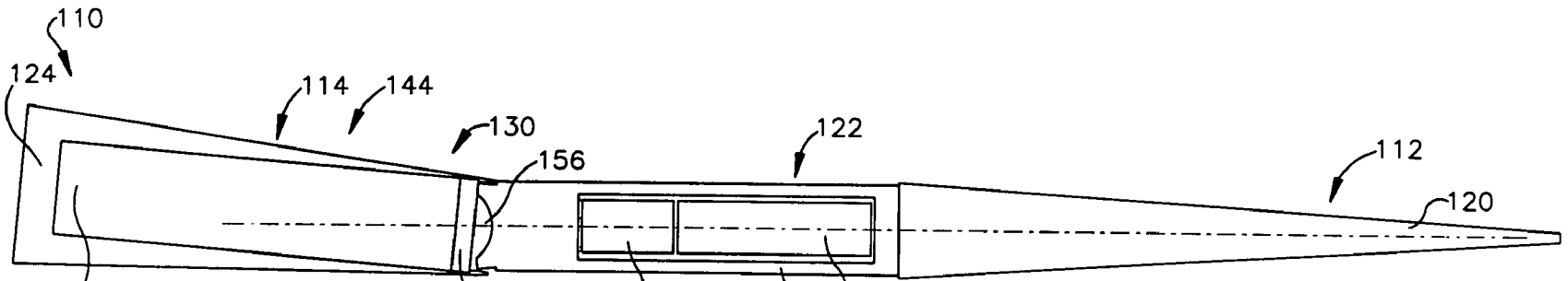
FIG. 9 is a side sectional view of the projectile of FIG. 7, with a base of the projectile articulated in order to steer the projectile.

FIGS. 7-9 illustrate an alternate embodiment projectile 110 that has an articulatable tail. The projectile 110 includes a forward portion 112 and an aft portion 114. The forward portion 112 includes a nose 120 and a central body 122. The aft portion 114 includes a base 124. The base 124 is slidable along the central body 122. In the launch configuration (FIG. 7) the central body 122 is inside a central cavity 126 in the base 124. In the flight configuration (FIGS. 8 and 9), the base 124 is in an extended or deployed position, having extended until a stop 130 is reached.

Instead of utilizing the lateral thrusters 46 of the projectile 10 (FIGS. 1 and 2), the projectile 110 uses an articulatable tail 144 to control direction of flight. The central body 122 includes a central body forward portion 150, which is attached to the nose 120, and a central body aft portion 152. The central body forward portion 150 houses a navigation system 140 and a battery 142. The central body aft portion 152 is tiltable relative to the central body forward portion 150. The aft portion 152 tilts relative to the forward portion 150 at a ball joint 156 (FIG. 7). An articulation mechanism 160 (FIG. 8) is used to tilt the tail 144 (the center body aft portion 152 and the base 124) relative to the center body forward portion 150 and the nose 120, as illustrated in FIG. 9. The articulation mechanism 160 may be a combination of motors, for example, 2 motors and 4 screws, for achieving a desired articulation of the tail 144. Power for the articulation mechanism 160 may be provided by the battery 142. The navigation system 140 may be used to suitably actuate the articulation mechanism 160, in order to tilt or articulate the base 124 in order to maintain the projectile 110 on a desired course.

Figure 10:
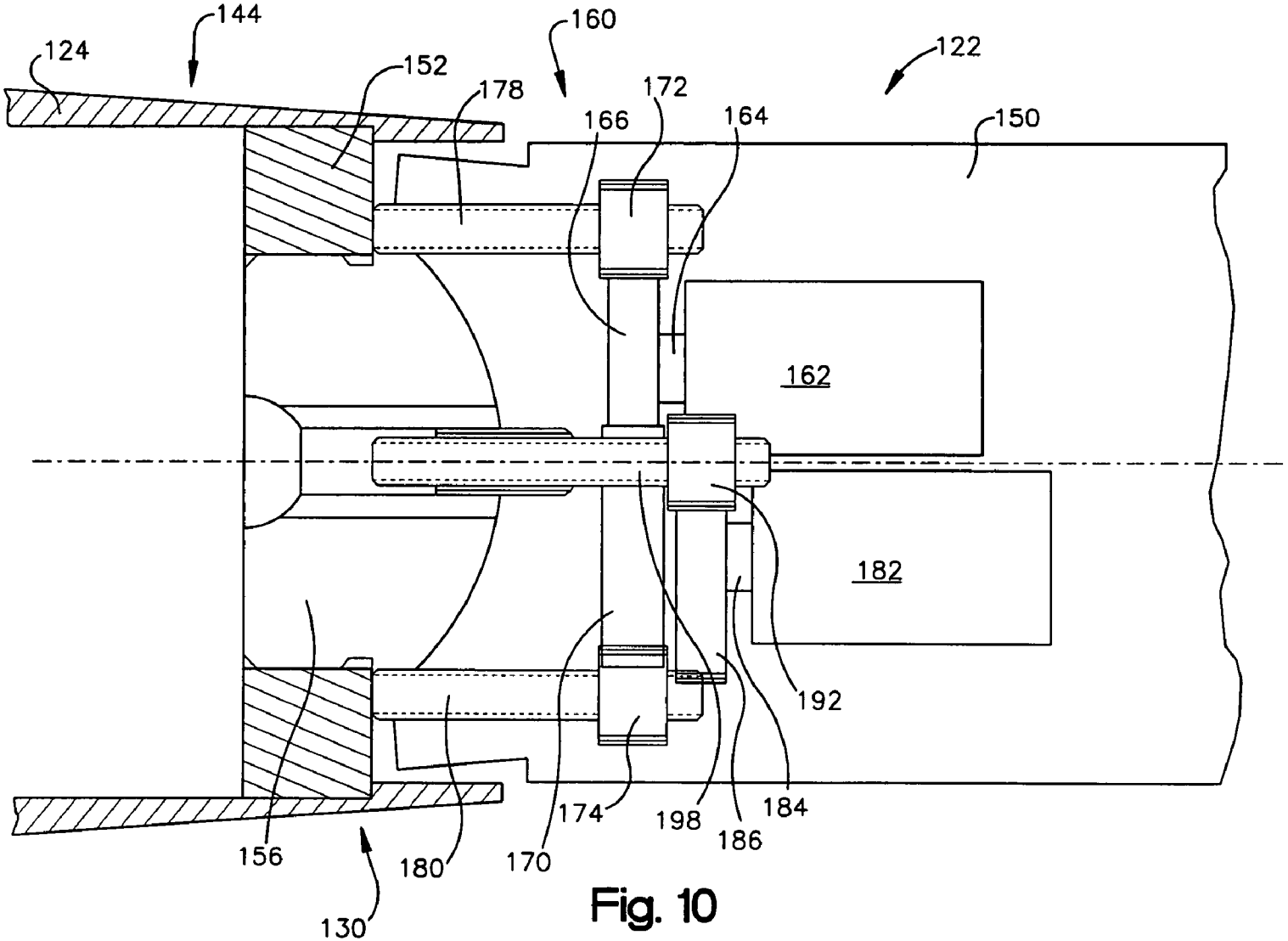
FIG. 10 is a side view showing one possible configuration of components of an articulation mechanism of the projectile of FIGS. 7-9.
Figure 12:
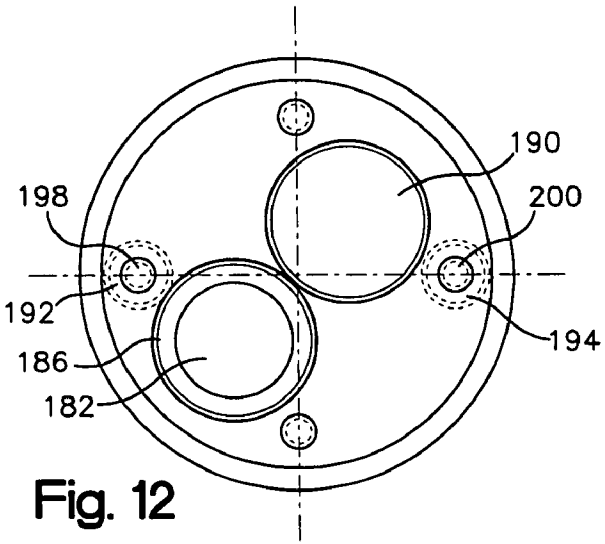
FIG. 12 is an end view illustrating how the articulation mechanism of FIG. 10 may be used to tilt in a second direction a tail of the projectile of FIG. 7.
Figure 11:
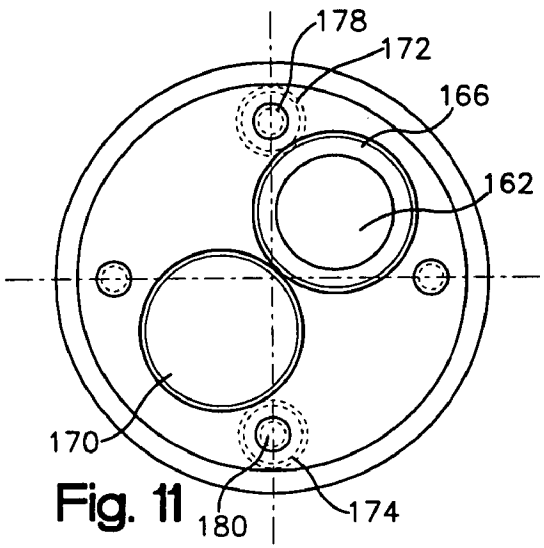
FIG. 11 is an end view illustrating how the articulation mechanism of FIG. 10 may be used to tilt in a first direction a tail of the projectile of FIG. 7.

FIGS. 10-12 shows one possible configuration of the articulation mechanism 160. The articulation mechanism 160 includes a first motor 162 having a shaft 164 coupled to a first pinion 166, and a first gear 170 that is engaged with the first pinion 166. The first pinion 166 and the first gear 170 are coupled to rotate a first pair of diametrically-opposed drive nuts 172 and 174 in opposite directions. Rotation of the first drive nuts 172 and 174 moves a first pair of jack screws 178 and 180 that threadedly engage respective of the drive nuts 172 and 174. Putting power to the first motor 162 thereby tilts the tail 144 in a first direction.

The articulation mechanism 160 also includes corresponding parts (a second motor 182 having a second shaft 184 coupled to a second pinion 186; a second gear 190; a second pair of drive nuts 192 and 194; and a second pair of jack screws 198 and 200) for tilting the tail 144 in a second direction.

Figure 13:
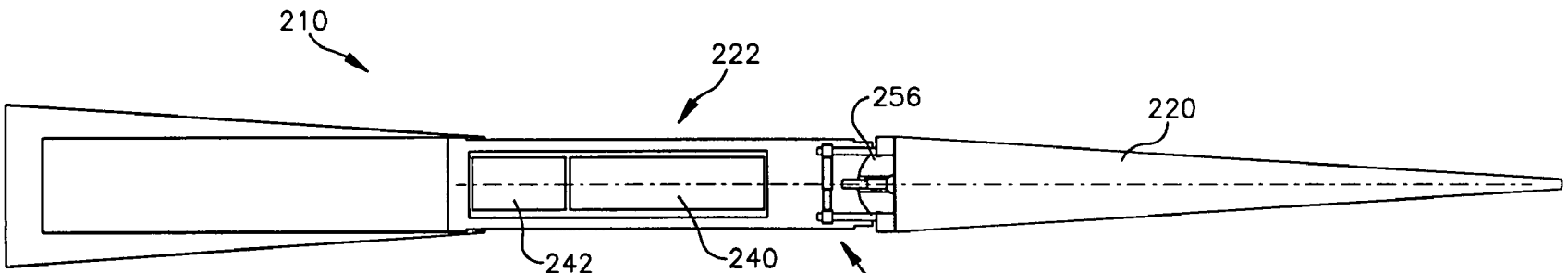
FIG. 13 is a side sectional view of another alternate embodiment projectile in accordance with the present invention.

FIG. 13 illustrates a further variant for directing flight of a projectile, a projectile 210 with an articulatable nose 220 that may be articulated relative to a central body 222. The nose 220 may articulate on a ball joint 256, with articulation controlled by an articulation mechanism 260. The ball joint 256 and the articulation mechanism 260 may be similar to the ball joint 156 and the articulation mechanism 160 of the projectile 110 (FIGS. 7-9). A battery 242 and a navigation system 240 may be used to provide power and direction to the articulation mechanism 260.

Other alternatives may be possible for controlling direction of a projectile during flight. Examples of other possible systems include liquid reaction jet control systems and (in some environments) aerodynamic controls.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A projectile comprising:

a forward portion; and an aft portion mechanically coupled to the forward portion;

wherein at least part of one of the portions is movable relative to the other of the portions such that:

1) a center of gravity of the projectile is forward of a center of pressure of the projectile when the at least part of the one of the portions is in a first relative position to the other of the portions; and 2) the center of gravity of the projectile is aft of the center of pressure of the projectile when the at least part of the one of the portions is in a second relative position to the other of the portions;

wherein the forward portion and the aft portion remain mechanically coupled to each other both when in the first relative position and in the second relative position;

wherein the forward portion includes:

a conical nose; and a central body that is attached to the nose;

wherein the aft portion includes a base that is slidably mounted around the central body;

wherein the base has a truncated conical outer surface; and wherein the nose and the base form a single conical shape when the at least part of the one of the portions is in a second relative position to the other of the portions; and wherein shifting between the first relative position and the second relative position changes an overall length of the projectile.

2. The projectile of claim 1, wherein the central body is substantially cylindrical.

3. The projectile of claim 1, wherein the central body has lateral thrusters mounted therein.

4. The projectile of claim 1, wherein the nose is a substantially solid metal nose.

5. The projectile of claim 1, wherein the projectile is a hypersonic projectile.

6. The projectile of claim 1, in combination with a sabot that at least partially encloses the projectile during launch.

7. The combination of claim 6, further in combination with an electro-magnetic rail launcher for launching the sabot and the projectile.

8. The projectile of claim 1, wherein the base covers substantially all of the central body when the at least part of the one of the portions is in a second relative position to the other of the portions.

9. The projectile of claim 3, wherein the lateral thrusters are covered by the base when the at least part of the one of the portions is in a second relative position to the other of the portions.

10. A proiectile comprising:

a forward portion; and an aft portion mechanically coupled to the forward portion;

wherein at least part of one of the portions is movable relative to the other of the portions such that:

1) a center of gravity of the projectile is forward of a center of pressure of the projectile when the at least part of the one of the portions is in a first relative position to the other of the portions; and 2) the center of gravity of the projectile is aft of the center of pressure of the projectile when the at least part of the one of the portions is in a second relative position to the other of the portions; and wherein the forward portion and the aft portion remain mechanically coupled to each other both when in the first relative position and in the second relative position;

wherein the forward portion includes:

a conical nose; and a central body that is attached to the nose;

wherein the aft portion includes a base that is slidably mounted around the central body;

wherein the center of gravity of the projectile is aft of the center of pressure of the projectile when the base is in a retracted position, with the central body fully inserted into the base; and wherein the center of gravity of the projectile is forward of the center of pressure of the projectile when the base is in an extended position, with the central body mostly not surrounded by the base, and with part of the base extending aft of all of the central body wherein the base has a truncated conical outer surface; and wherein the nose and the base form a single conical shape when the at least part of the one of the portions is in a second relative position to the other of the portions.

11. The projectile of claim 10, further comprising a mechanical stop thereon to prevent movement of the base beyond the extended position.

12. The projectile of claim 10, wherein the central body includes an articulatable aft part that may be articulated relative to a forward part of the central body in order to articulate the base when the base is in the extended position.

13. A method of delivering a projectile to a target, the method comprising:

launching the projectile in a launch configuration with a center of gravity of the projectile aft of a center of pressure of the projectile;

shifting the projectile to a flight configuration with the center of gravity forward of the center of pressure, wherein the shifting includes increasing an overall length of thee projectile; and flying the projectile to the target wherein the shifting includes changing relative positions of an aft portion of the project and a forward portion of the project; wherein the forward portion of the projectile includes a nose portion, and a central body attached to the nose portion; wherein the aft portion of the projectile includes a base slidably mounted on the central body; and wherein the shifting includes sliding the base relative to the central body; wherein the forward portion of the projectile and the aft portion of the projectile remain mechanically coupled to each other both when in the launch configuration and in the flight configuration; wherein said forward portion of the projectile and said aft portion of the projectile form a single conical shape when the projectile is in the launch configuration.

14. The method of claim 13, wherein the launching includes accelerating the projectile at at least 30,000 g's.

15. The method of claim 13, wherein the launching includes using an electro-magnetic rail launcher to accelerate the projectile.

16. The method of claim 13, wherein the flying includes guiding the projectile to the target.

17. The method of claim 16, wherein the guiding includes firing lateral thrusters to guide the projectile.

* * * * *